US007850329B2

(12) United States Patent
Henry et al.

(10) Patent No.: US 7,850,329 B2
(45) Date of Patent: Dec. 14, 2010

(54) FLASHLIGHT WITH INTEGRATED CLAMP HANDLE

(75) Inventors: Louis F. Henry, Scarsdale, NY (US); Justin Cohen, Brooklyn, NY (US)

(73) Assignee: Blackbeam, LLC, New York, NY (US)

( * ) Notice: Subject to any disclaimer, the term of this patent is extended or adjusted under 35 U.S.C. 154(b) by 0 days.

(21) Appl. No.: 12/151,330

(22) Filed: May 6, 2008

(65) Prior Publication Data

US 2009/0279289 A1 Nov. 12, 2009

(51) Int. Cl.
*F21L 4/00* (2006.01)

(52) U.S. Cl. ..... 362/191; 362/197; 362/199; 362/396; 362/399

(58) Field of Classification Search ..... 362/190, 362/191, 197, 199, 396, 399; D26/60
See application file for complete search history.

(56) References Cited

U.S. PATENT DOCUMENTS

| | | | | | |
|---|---|---|---|---|---|
| 4,533,982 | A | | 8/1985 | Kozar | 362/183 |
| 4,654,764 | A | | 3/1987 | Hsiao | 362/199 |
| D324,110 | S | | 2/1992 | Yuen | D26/44 |
| 5,448,463 | A | * | 9/1995 | Leen | 362/396 |
| D376,865 | S | * | 12/1996 | Chan | D26/60 |
| D378,434 | S | | 3/1997 | Petterson et al. | D26/44 |
| D404,839 | S | | 1/1999 | Petterson et al. | D26/44 |
| D410,557 | S | | 6/1999 | Petterson et al. | D26/44 |
| 5,993,022 | A | * | 11/1999 | Neyer et al. | 362/199 |
| D428,175 | S | | 7/2000 | Lynch et al. | D26/44 |
| 6,176,592 | B1 | | 1/2001 | Kovacik et al. | 362/199 |
| 6,457,841 | B1 | | 10/2002 | Lynch et al. | 362/199 |
| D467,375 | S | | 12/2002 | Dalton et al. | D26/44 |
| 6,575,587 | B2 | | 6/2003 | Cramer et al. | 362/105 |
| 6,585,400 | B2 | | 7/2003 | Leen | 362/418 |
| D496,483 | S | | 9/2004 | Christianson | D26/60 |
| 6,802,623 | B1 | | 10/2004 | Hsu et al. | 362/199 |
| 6,905,223 | B2 | | 6/2005 | Halasz | 362/197 |
| 6,913,370 | B2 | | 7/2005 | Ping | 362/199 |
| 7,011,423 | B2 | | 3/2006 | Chen | 362/102 |
| 7,040,783 | B1 | * | 5/2006 | Christianson | 362/396 |
| 7,111,965 | B2 | | 9/2006 | Hsu | 362/396 |
| 7,172,310 | B2 | | 2/2007 | Hsu | 362/197 |
| 7,175,318 | B2 | * | 2/2007 | Booty, Jr. | 362/396 |
| D541,965 | S | | 5/2007 | Shiu | D26/60 |
| D542,450 | S | | 5/2007 | Shiu | D26/60 |
| 7,222,996 | B2 | * | 5/2007 | Lin | 362/396 |
| D554,783 | S | | 11/2007 | Shiu | D26/39 |
| 7,318,657 | B2 | | 1/2008 | Booty, Jr. | 362/190 |
| 7,357,540 | B2 | | 4/2008 | Booty, Jr. | 362/396 |
| 7,390,105 | B2 | | 6/2008 | Nelson et al. | 362/198 |
| 7,481,554 | B2 | | 1/2009 | Anderson et al. | 362/250 |
| 7,513,662 | B2 | | 4/2009 | Parker et al. | 362/396 |

(Continued)

OTHER PUBLICATIONS

International Search Report from corresponding PCT/US2009/042830 dated Jul. 7, 2009.

*Primary Examiner*—Stephen F Husar
(74) *Attorney, Agent, or Firm*—Ohlandt, Greeley, Ruggiero & Perle, L.L.P.

(57) ABSTRACT

A flashlight having a handle with a clamp integrated therein, so that the flashlight can be used in either hands-free or in a portable mode. A battery compartment is disposed within one of the clamp arms.

17 Claims, 6 Drawing Sheets

U.S. PATENT DOCUMENTS

| | | | | |
|---|---|---|---|---|
| 7,540,623 | B2 | 6/2009 | Petzl et al. | 362/197 |
| 7,572,024 | B2 * | 8/2009 | Ko et al. | 362/191 |
| D605,795 | S | 12/2009 | Baker et al. | D26/44 |
| 2007/0076410 | A1 | 4/2007 | Halasz | 362/197 |
| 2008/0055888 | A1 | 3/2008 | Sharrah et al. | 362/106 |
| 2009/0122562 | A1 | 5/2009 | Lee | 362/396 |
| 2009/0154161 | A1 | 6/2009 | Parker et al. | 362/249.05 |
| 2010/0091483 | A1 * | 4/2010 | Henry et al. | 362/191 |

* cited by examiner

FLASHLIGHT WITH INTEGRATED CLAMP HANDLE

BACKGROUND OF THE DISCLOSURE

1. Field of the Disclosure

The present disclosure relates to flashlights having handles that have a clamp integrated therein.

2. Background

There is a significant need among users of flashlights to have some sort of "hands-free" capability, so that the user can have both hands available to work on a task while the flashlight illuminates a work space. Some currently available flashlights, however, require additional bulky mechanisms that need to be affixed to the flashlight, and take up a lot of space, to provide this utility. In addition, other currently available flashlights that can illuminate a space and allow for hands-free operation by a user are not portable, and can not be easily manipulated or carried around by the user. There are no flashlights available that can provide both capabilities at the same time.

Accordingly, there is a need for a flashlight that can provide hands-free operation for a user, while simultaneously providing a portable capability.

SUMMARY OF THE DISCLOSURE

The present disclosure overcomes these and other disadvantages of the flashlights of the prior art by providing a novel illumination device, such as a flashlight, that integrates a clamp that can be affixed to an object into a handle of the device. This allows the flashlight to be used in either hands-free or portable modes.

Thus, in one embodiment the present disclosure provides an illumination device. The illumination device comprises a light-emitting portion, a support member, wherein the light-emitting portion is connected to the support member, and a clamp having one end connected to the support member, and an opposite end having a gripping portion.

The present disclosure also provides an illumination device that comprises a head having a light-emitting portion, a mount operably connected to the head, and a handle operably connected to the mount, the handle comprising a first arm and a second arm, wherein the second arm is pivotally connected to the first arm.

The present disclosure further provides an illumination device that comprises a head comprising a light-emitting portion, and a handle rotatably connected to the head. The handle comprises a clamp integrally formed therein.

DETAILED DESCRIPTION OF THE DISCLOSURE

Figure 1:
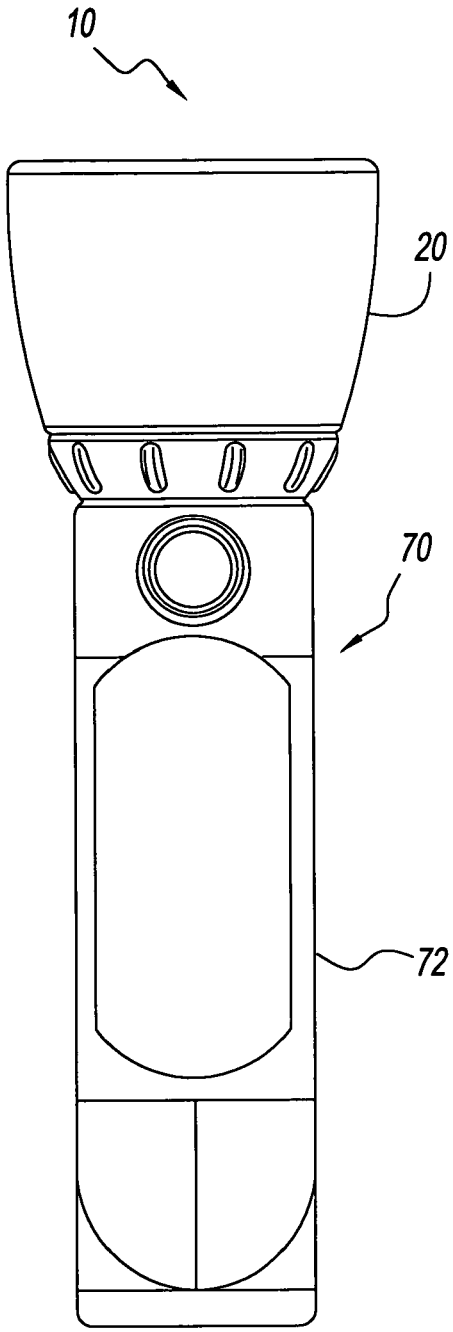
FIG. 1 is a top view of the flashlight of the present disclosure.
Figure 2:
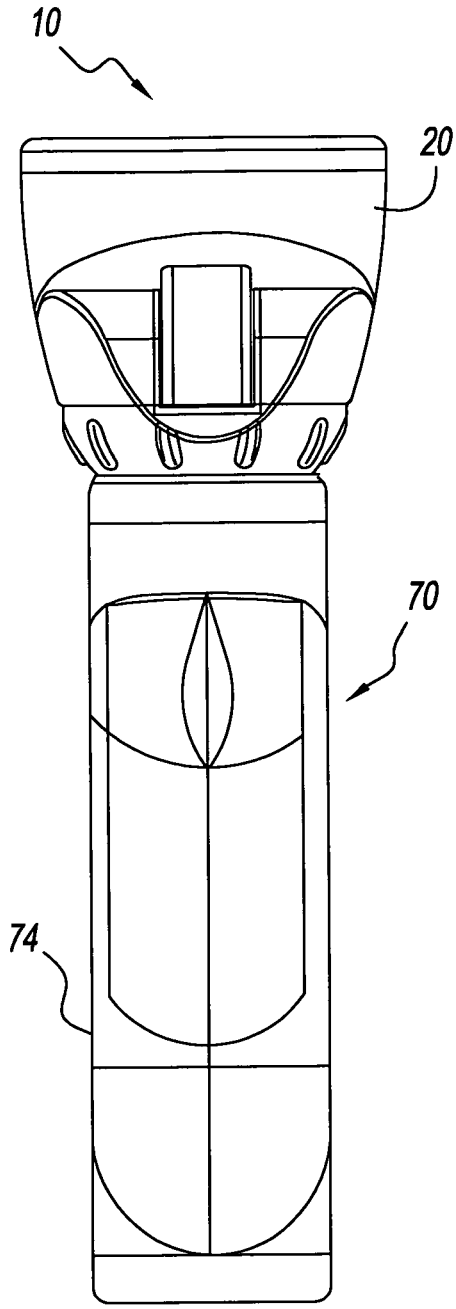
FIG. 2 is a bottom view of the flashlight of FIG. 1.
Figure 3:
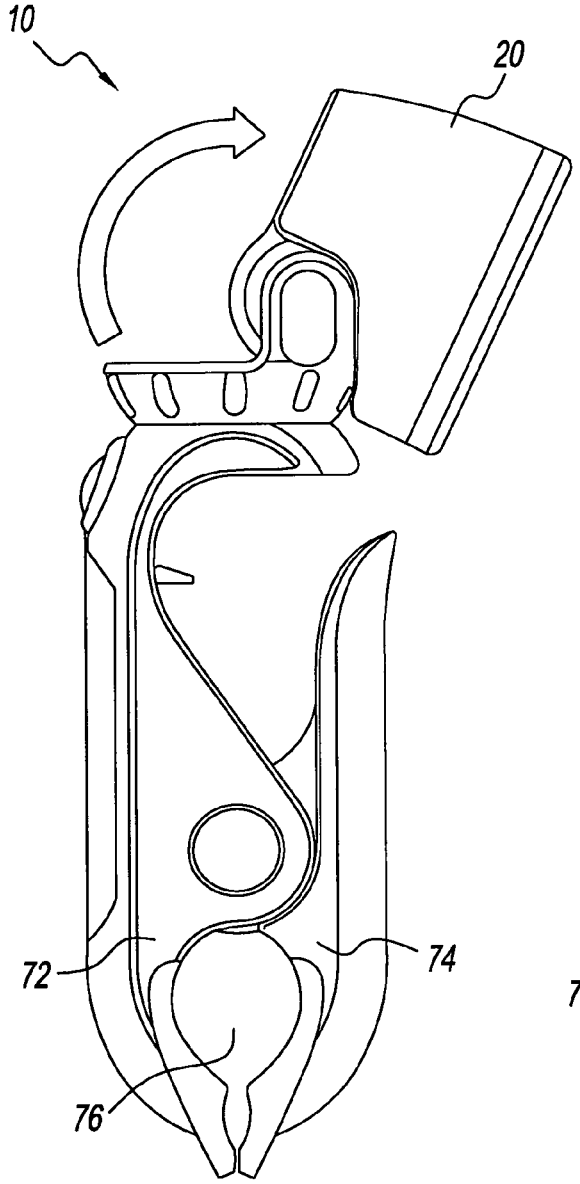
FIG. 3 is a right-side view of the flashlight of FIG. 1.

Referring to FIGS. 1-8, flashlight 10 of the present disclosure is shown. Flashlight 10 has a head 20 and a handle 70. Handle 70 further comprises a main arm 72 and a clamp arm 74, which are mounted to each other in such a way as to be biased in a closed position, as shown in FIG. 3. Main arm 72 and clamp arm 74 can be gripped and squeezed together by a user, such that a clamp 76, defined by an end of main arm 72 and an end of clamp arm 74, opens, and can be attached to a fixed object. When clamp 76 is in its closed position, main arm 72 and clamp arm 74 can be easily held by a user, rendering flashlight 10 portable.

The present disclosure therefore provides a flashlight 10, that a user can use in hands-free operation by attaching it to a fixed object, which still remains portable for the user. Clamp 76 is integrated into the handle 70, so that handle 70 can double as a grip for the user for portable use, and can also be used to affix flashlight 10 to a stationary object. This is a significant improvement over the flashlights of the prior art, which use cumbersome methods to affix the flashlight to a stationary object, and which are not portable. Flashlight 10 of the present disclosure can have a similar profile to a traditional flashlight when clamp 76 is closed, as main arm 72 and clamp arm 74 can form a substantially cylindrical body for handle 70.

The present disclosure also provides a unique battery housing 78 and battery cover 80, which in one embodiment can be integrated into main arm 72. This also represents a significant advantage over the flashlights of the prior art, which often require bulky tubes or cylinders for holding batteries.

For ease of describing flashlight 10, the words "front," "back," "top," and "bottom" will be used from the point of view of a user pointing head 20 at an object, with main arm 72 on top of clamp arm 74. These directional terms are used only for describing flashlight 10, and are not meant to limit the interpretation of the features discussed below.

Figure 8:
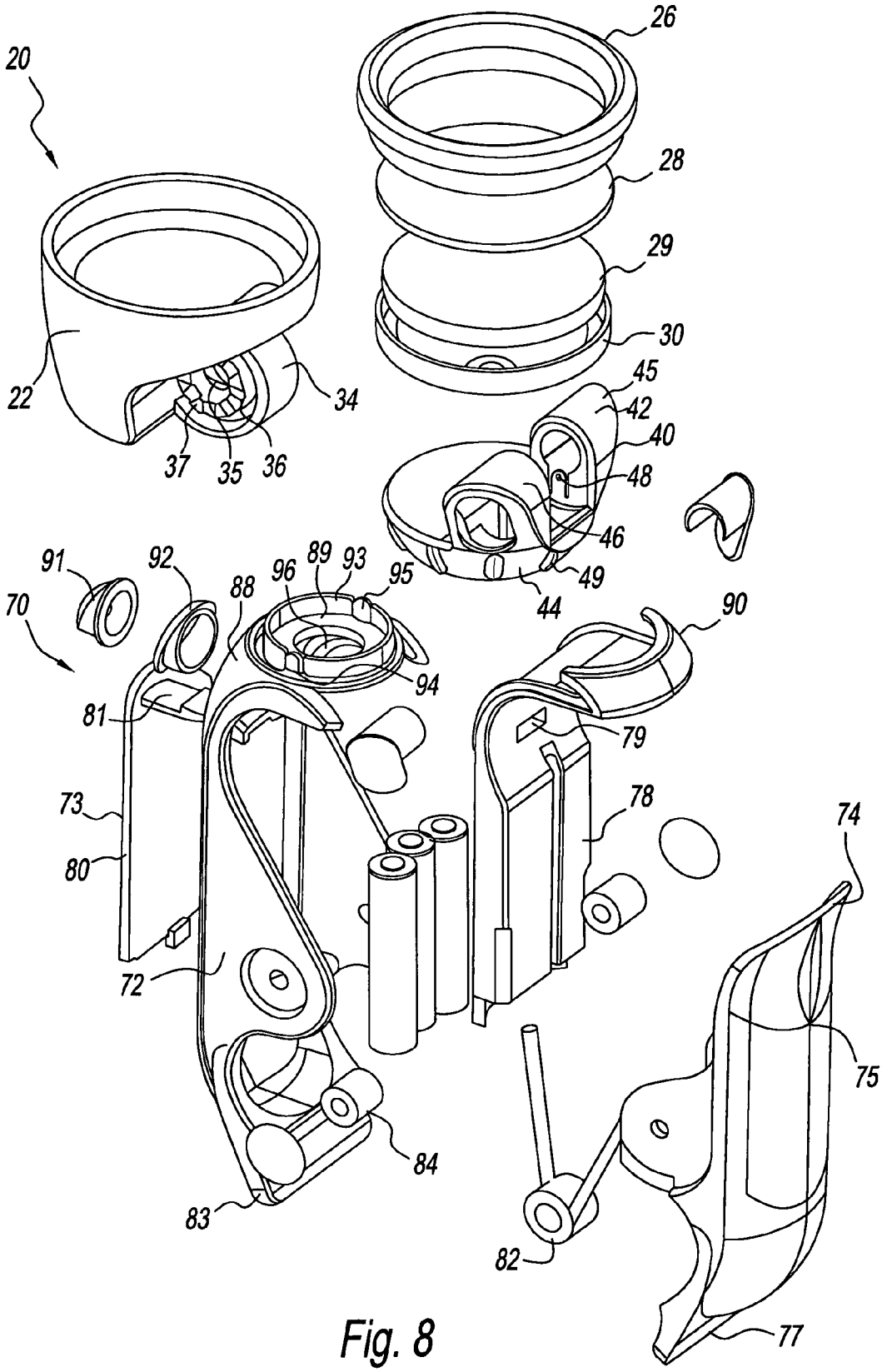
FIG. 8 is an exploded view of the flashlight of FIG. 1.

Referring specifically to FIG. 8, an exploded view of flashlight 10 and handle 70 is shown. As previously discussed, main arm 72 and clamp arm 74 are biased into a closed position. A spring, actuator, or other device 82 can be placed between main arm 72 and clamp arm 74 as shown, to create tension between main arm 72 and clamp arm 74 and effect the bias. Main arm 72, clamp arm 74, and device 82 can be connected to each other with a pivot pin (not shown) that travels through corresponding holes in main arm 72, clamp arm 74, device 82, a pair of spacers 84, and a pair of pin covers 83. Spacers 84 and covers 83 can be used to stabilize device 82.

In the shown embodiment, device 82 is a torsion spring. The present disclosure, however, contemplates any devices 82 that can create tension between main arm 72 and clamp arm 74, such as tension springs, extension springs, compression springs, integral plastic springs, wire or coil springs, and flat springs. These devices can be positioned around the axis of rotation of clamp arm 74, or in another location.

Thus, a user can grasp handle 70, and squeeze a front end of clamp arm 74 toward main arm 72, which opens clamp 76. Clamp 76 can then be affixed to an object, to allow for hands-free operation of flashlight 10. Alternatively, the user can grasp or hold handle 70, and use flashlight 10 in a portable manner. This dual capability of handle 70 provides a convenience not found in the prior art. Currently available flashlights having clamps that can be affixed to objects are not designed for portable use. Currently available flashlights that are portable, however, do not have the ability to be affixed to an object.

The top end of main arm 72 and/or battery cover 80 can have an overmold 73 attached thereto, to provide for easier gripping of handle 70. Clamp arm 74 can also have an overmold 75 disposed on a bottom surface, and the ends of main arm 72 and clamp arm 74 that form clamp 76 can each be covered with an overmold 77, to prevent clamp 76 from marking the surface to which it is affixed. All of the overmolds 73, 75, and 77 can be made with a material such as thermoplastic rubbers or other elastomers.

Main arm 72 also has battery housing 78 and battery cover 80 connected thereto. Battery cover 80 can connect to battery housing 78 through a hole in the top surface of main arm 74. In the shown embodiment, battery cover 80 can have a clasp 81 that can mate with an aperture 79 in battery housing 79, to hold the two components together, and define a space in which batteries 71 are kept. Battery housing 78 can also be connected to main arm 72 with other methods, such as a snap fit or friction fit connection. As seen in FIG. 3, when battery housing 78 and battery cover 78 are connected to main arm 72, the thin profile of main arm 72 is not adversely affected. This space-saving feature of flashlight 10 allows for the space between main arm 72 and clamp arm 74 to remain substantially hollow, which facilitates in the ability of flashlight 10 to be affixed to an object, in the manner described above. This is a significant improvement over currently available flashlights, which often require bulky battery compartments that occupy a significant portion of the space within the handle.

In the shown embodiment, battery housing 78 houses three triple-A (AMA) batteries 71. However, the present disclosure contemplates a number of different batteries 71, or a single battery 71, that can be used in flashlight 10. Smaller batteries can be placed in any number of locations within flashlight 10, and are not limited to main arm 72. For example, batteries 71 can also be disposed in a compartment disposed within clamp arm 74, or within head 20. Batteries 71 can also be disposed within main arm 72, at a front end 88 closer to head 20.

Figure 4:
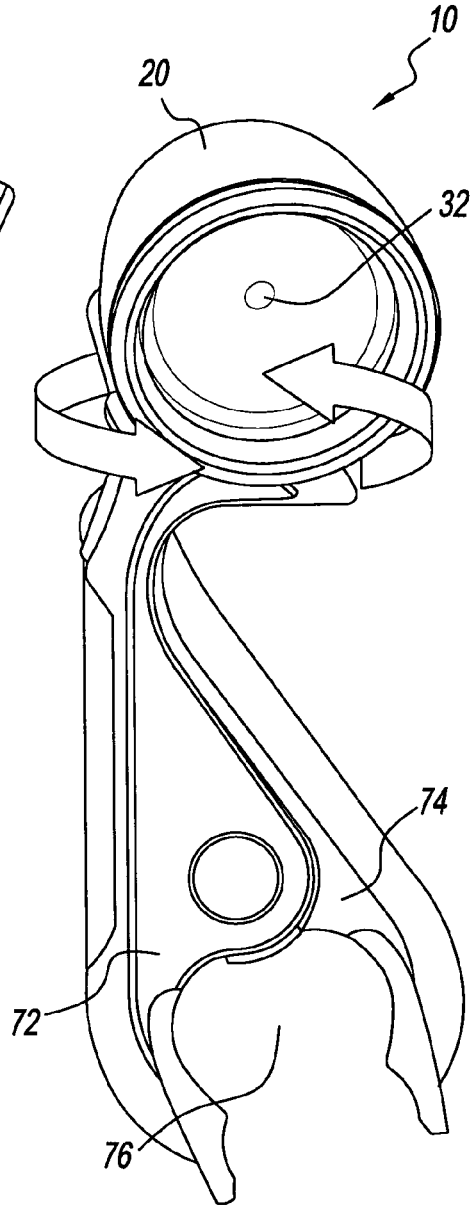
FIG. 4 is a right-side view of the flashlight of FIG. 1, showing the clamp in a closed position.
Figure 5:
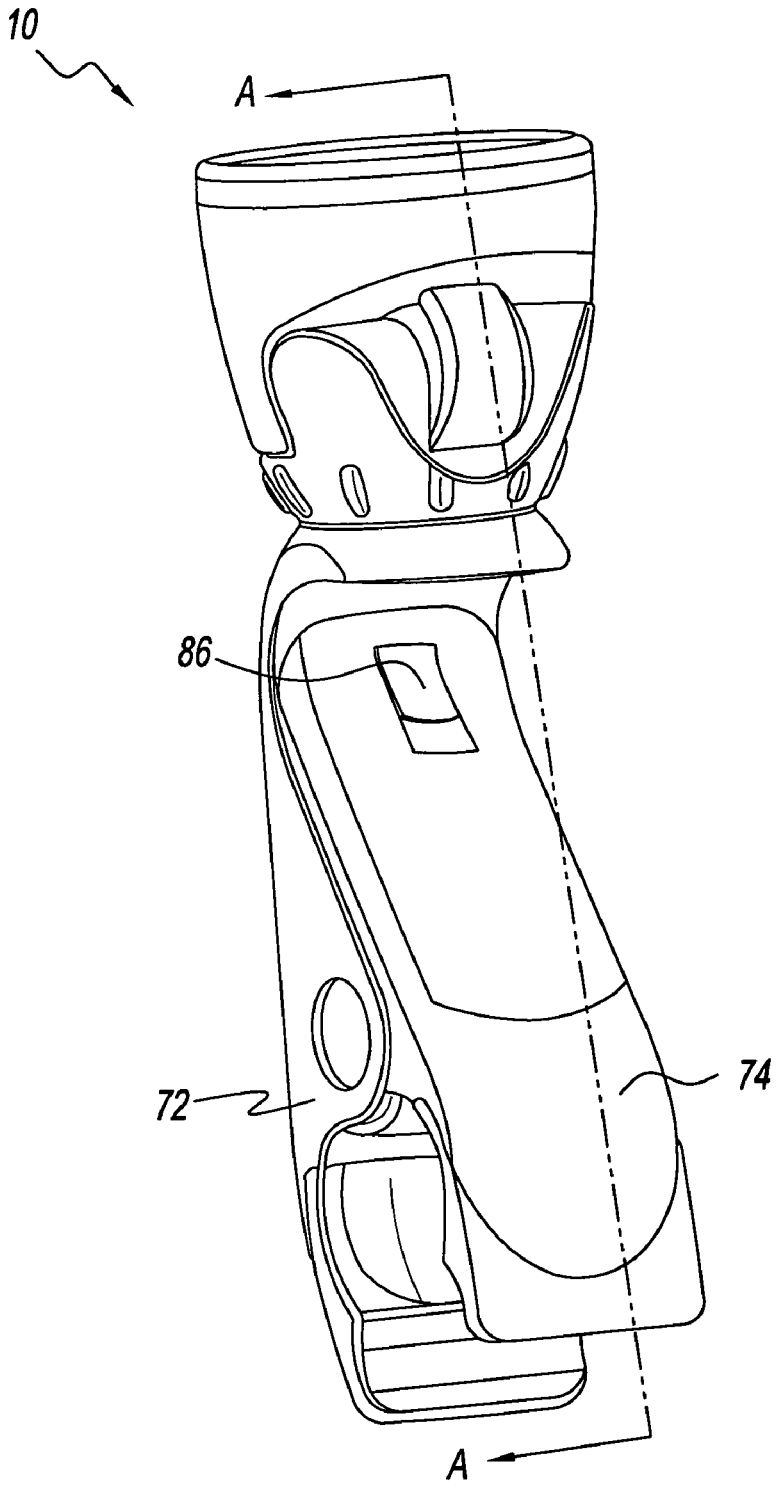
FIG. 5 is a bottom, left-side perspective view of a second embodiment of the flashlight of the present disclosure.
Figure 6:
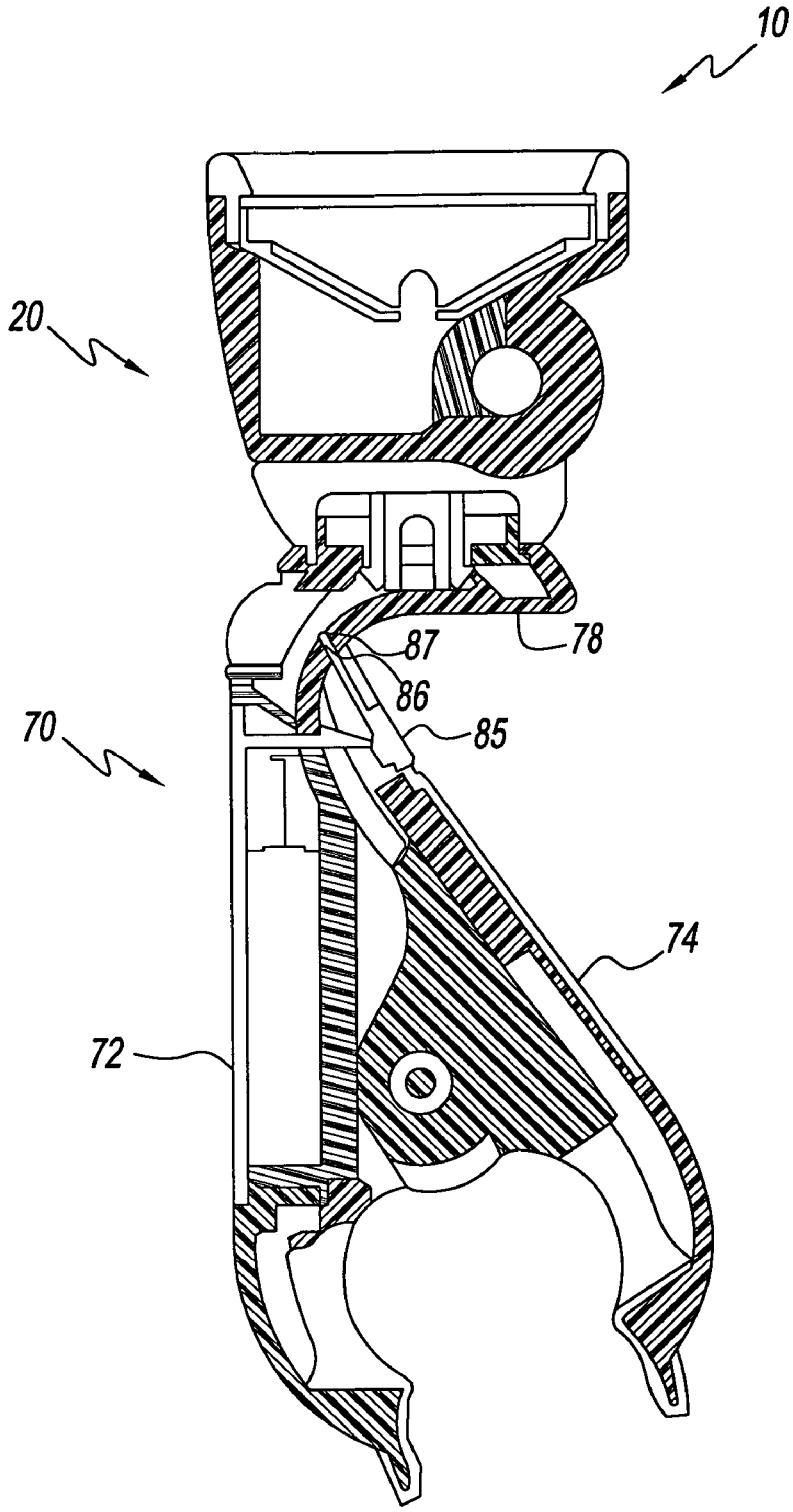
FIG. 6 is a vertical cross-sectional view, as would be seen along line A-A, of the flashlight of FIG. 5.
Figure 7:
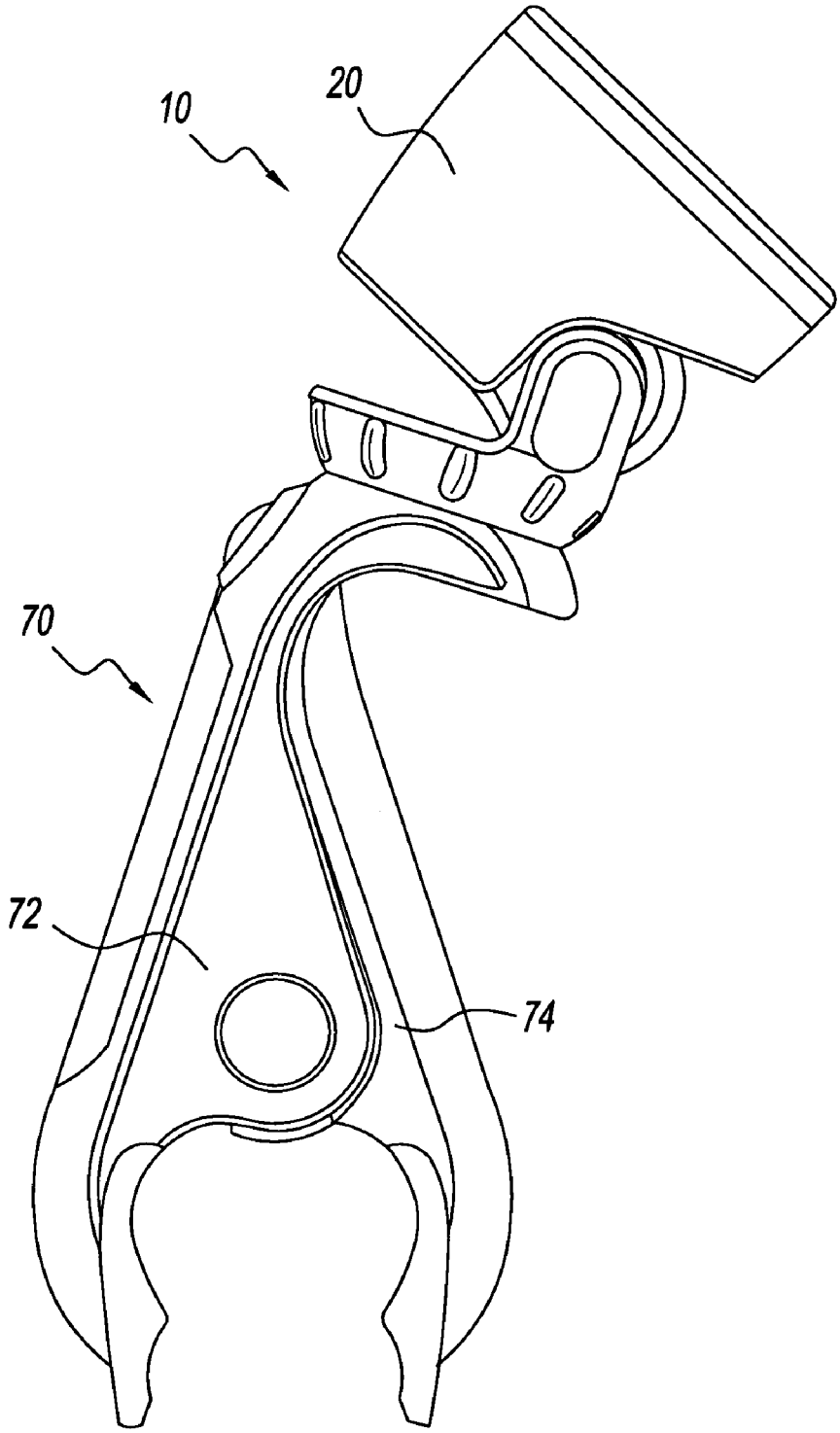
FIG. 7 is a second right-side view of the flashlight of FIG. 1, showing the clamp in a closed position.

Referring specifically to FIGS. 5 and 6, in one embodiment, clamp arm 74 can also have a latch 85 disposed on the bottom surface thereon. Latch 85 can have a front end 86 that is disposed within a hollow front end of clamp arm 74. When latch 85 is pushed in a forward direction by a user, front end 86 engages a cavity 87 that can be disposed in battery housing 78 and/or main arm 72. When latch 85 engages cavity 87 in this manner, clamp 76 remains in the open position, as shown in FIG. 4 or 7, and flashlight 10 can be placed on a surface. This provides yet another mode of operation for flashlight 10, in addition to those described above. The present disclosure also contemplates other methods for keeping clamp 76 in the open position. For example, similar mechanisms to latch 86 can be disposed on battery housing 78, and/or on main arm 72. There may also be such a mechanism disposed on first arm 72 and/or clamp arm 74, in the vicinity of device 82 or spacers 84.

Button membrane 91 and button bezel 92 are connected to front end 88 of main arm 72, for example with a friction or snap fit connection. Button membrane 91 can selectively place the batteries disposed within battery housing 78 in electrical communication with a light source 32 (shown in FIG. 4) disposed within head 20, in the manner discussed below. Thus, a user can turn light source 32 on and off by pressing button membrane 91.

Front end 88 can curve down in a direction toward the front of flashlight 10, so that a flat portion 89 of front end 88 faces the front of flashlight 10. The profile of battery housing 78 can mirror that of front end 88. Battery housing 78 can also have a lip 90, which wraps around the tip of front end 88, and engages flat portion 89 as shown, thus sealing the compartment disposed between battery housing 78 and battery cover 80 from outside elements.

Head 20 has body 22 and tapered end 24. Body 22 has a substantially cylindrical profile, and tapered end 24 narrows in the direction of handle 70. Body 22 also has bezel 26 connected thereto. When assembled, head 20 has lens 28, cover 29, lens housing 30, and light source 32 disposed therein. These components are concerned with the optics of flashlight 10, and ensure that a proper beam is directed out of head 20. Cover 29 can be made of an acrylic. Bezel 26 fits over lens 28, cover 29, lens housing 30, and light source 32, and contains these components within head 20. Light source 32 can be a light-emitting diode (LED).

Body 22 has a pivot wheel 34 connected thereto. Pivot wheel 34 can be a separate component that is connected or fastened to body 22, or can be integrally formed as one component with body 22. Head 20 further has mount 40, to which pivot wheel 34 is operably connected. Mount 40 can have a pivot portion 42, and a rotary portion 44. Rotary portion 44 can have a first arm 45 and a second arm 46, each of which are hollow. A pivot pin (not shown) can pass through the hollow portions of first arm 45 and second arm 46, and also through a hole 35 within pivot wheel 34. In this manner, head 20 can rotate about the longitudinal axis of the pivot pin, in a direction away from, and back toward, rotary portion 44 of mount 40.

In one embodiment, pivot wheel 34 can rotate about pivot portion 42 in the manner described above, and the user can place head 20 in any position along the arc of rotation. A friction fit between pivot wheel 34, first arm 45, and second arm 46 ensures that head 20 stays in the desired position. In another embodiment, pivot wheel 34 can have a raised inner diameter 36, on one or both sides of pivot wheel 34, and a plurality of bumps 37 disposed thereon. First arm 45 and/or second arm 46 can have an awl 48 disposed therein. When pivot wheel 34 is operably connected to pivot portion 42 of mount 40 in the manner described above, awl 48 can engage grooves located between bumps 37 of inner diameter 36. In this manner, there can be one or more "stops" along the arc of rotation of head 20.

Rotary portion 44 of mount 40 can be separately formed from, and connected to, pivot portion 42. Alternatively, the two can be integrally formed as one component. Rotary portion 44 can be rotatably connected to main arm 72 of handle 70, and can rotate about a longitudinal axis of handle 70. Raised edge 93, disposed on flat portion 89 of main arm 72, can engage a groove (not shown) on an underside of rotary portion 44. In one embodiment, flat portion 89 has a pair of stops 94 disposed thereon, that can limit the rotation of rotary portion 44.

Rotary portion 44 of mount 40 can also have an inner diameter (not shown) disposed on an underside thereof, with a plurality of grooves disposed thereon. Flat portion 89 can also have second awls 95 disposed thereon, which can engage the grooves in the inner diameter of rotary portion 44. In this manner, rotary portion 44 can have a number of discrete stops along the arc of rotation. In another embodiment, rotary portion 44 can be placed in any position along the arc of rotation by a user. Rotary portion 44 can also have a plurality of grips 49 disposed thereon, which can assist with the user with the adjustment of mount 40.

The inner diameter of rotary portion 44 can also have a pair of lead holes (not shown) disposed therein. Light source 32 can be in electrical communication with the batteries disposed within battery housing 78 via electrical leads that are passed through these lead holes, through a center hole 96 disposed on flat portion 89 of main arm 72, to button membrane 91, and the batteries.

Any of the above described components can be made of materials such as acrylonitrile butadiene styrene (ABS), nylon, or other plastics, or can be made of cast or stamped metal.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated for carrying out this disclosure, but that the disclosure will include all embodiments falling within the scope of the claims.

What is claimed is:

1. An illumination device, comprising:

a light-emitting portion;

a support member, wherein said light-emitting portion is connected to said support member;

a clamp having one end connected to said support member, and an opposite end having a gripping portion, wherein said clamp has a first arm, and a second arm pivotably connected to said first arm; and at least one battery compartment disposed within at least one of said first arm and said second arm, wherein said clamp is substantially cylindrically shaped.

2. The illumination device of claim 1, wherein said first arm and said second arm are bias mounted to each other, so that said clamp is inclined toward a closed position.

3. The illumination device of claim 2, wherein said first arm and said second arm are biased together with a spring.

4. The illumination device of claim 1, wherein said light-emitting portion is pivotably mounted to said support member, and said support member is rotatably connected to said clamp.

5. The illumination device of claim 1, wherein at least one of said first arm and said second arm have overmolds disposed on a surface thereon.

6. The illumination device of claim 1, wherein said second arm has a latch disposed thereon, wherein said latch connects an end of said second arm opposite said gripping portion to said first arm, so that said clamp is in an open position.

7. The illumination device of claim 1, further comprising an additional battery compartment disposed within said light-emitting portion.

8. The illumination device of claim 1, wherein said handle further comprises a hollow interior between said first arm and said second arm.

9. A illumination device, comprising:

a head having a light-emitting portion;

a handle having a first end rotatably connected to said head, said handle comprising a first arm and a second arm, wherein said second arm is pivotally connected to said first arm, wherein said first arm and said second arm form a clamp comprising a gripping portion at a second end of said handle that is opposite to said first end, and wherein said first arm and said second arm are bias mounted to each other, so that said clamp is inclined toward a closed position; and at least one battery compartment disposed within at least one of said first arm and said second arm.

10. The illumination device of claim 9, wherein said handle is substantially cylindrically shaped.

11. The illumination device of claim 9, further comprising an additional battery compartment disposed within said head.

12. The illumination device of claim 9, wherein said handle further comprises a hollow interior between said first arm and said second arm.

13. A illumination device, comprising:

a head comprising a light-emitting portion; and a handle rotatably connected to said head at a first end of said handle, said handle comprising a clamp integrally formed therein, said clamp comprising a first arm, a second arm connected to said first arm, and a gripping portion at a second end of said handle that is opposite to said first end; and at least one battery compartment disposed within at least one of said first arm and said second arm.

14. The illumination device of claim 13, wherein said first arm and said second arm are bias mounted to each other, so that said clamp is inclined toward a closed position.

15. The illumination device of claim 13, wherein said handle is substantially cylindrically shaped.

16. The illumination device of claim 13, further comprising an additional battery compartment disposed within said head.

17. The illumination device of claim 13, wherein said handle further comprises a hollow interior between said first arm and said second arm.

* * * * *